US006055787A

United States Patent [19]

Gerhaher et al.

[11] Patent Number: 6,055,787

[45] **Date of Patent: *May 2, 2000**

[54] EXTERNALLY SUSPENDED FACADE SYSTEM

[76] Inventors: Max Gerhaher, Dr.-Aicher Str. 3, 94405 Landau; Franz Gerhaher, Stadtgraben 20, 94306 Straubing, both of Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/069,664

[22] Filed: Apr. 29, 1998

[30] Foreign Application Priority Data

May 2, 1997 [DE] Germany ..... 197 18 716

[51] Int. Cl.[7] ..... E04D 1/24

[52] U.S. Cl. ..... 52/546; 52/547; 52/551; 52/553; 52/506.06

[58] Field of Search ..... 52/546, 547, 551, 52/553, 702, 712, 506.06

[56] References Cited

U.S. PATENT DOCUMENTS

| | | | |
|---|---|---|---|
| 240,729 | 4/1881 | Jones | 52/712 |
| 2,292,984 | 8/1942 | Alavrez, Jr. | 52/520 |
| 2,308,790 | 1/1943 | Stagg | 52/520 |
| 2,648,103 | 8/1953 | Wahlfeld | 52/520 |
| 2,820,257 | 1/1958 | Newton | 52/546 |
| 2,832,212 | 4/1958 | Olsen | 52/712 |
| 3,015,193 | 1/1962 | Amoruso | 52/551 |
| 3,738,076 | 6/1973 | Kessler | 52/547 |
| 5,050,362 | 9/1991 | Tal et al. | 52/588 |
| 5,277,009 | 1/1994 | Yamaguchi et al. | 52/387 |
| 5,347,784 | 9/1994 | Crick et al. | 52/520 |
| 5,501,050 | 3/1996 | Ruel | 52/513 |
| 5,575,127 | 11/1996 | O'Neal | 52/520 |
| 5,651,227 | 7/1997 | Anderson | 52/520 |
| 5,653,079 | 8/1997 | Loeffler et al. | 52/712 |
| 5,729,947 | 3/1998 | Dawes | 52/521 |
| 5,791,093 | 8/1998 | Diamond | 52/36.5 |
| 5,860,257 | 1/1999 | Gerhaher et al. | 52/235 |

FOREIGN PATENT DOCUMENTS

| | | | |
|---|---|---|---|
| 3324060 | 1/1985 | Germany . | |
| 3329812 | 2/1985 | Germany . | |
| 3401271 | 7/1985 | Germany | 52/546 |

*Primary Examiner*—Carl D. Friedman
*Assistant Examiner*—Phi Dieu Tran A
*Attorney, Agent, or Firm*—Ostrolenk, Faber, Gerb & Soffen, LLP

[57] ABSTRACT

An externally suspended, back-ventilated facade system comprises a subsystem (1) having horizontal and/or vertical sections (2) and facade boards (3) with or without head rabbet (4) at the upper board edge (5) and having a drop rabbet (6) and foot rabbet (7) at the lower board edge (8), which can be fixed by means of board holders (9) to the vertical or horizontal sections (2). In order to be able to lay the facade boards with a shingle-type overlap, the drop rabbet (6) of the upper facade board (10) engages over the front surfaces (11) of the upper board edge (5) of the lower facade board (12), in such a manner that the front surfaces (13) of the upper facade boards (10) are arranged, in the region of the drop rabbet (6), in front of the front surfaces (11) of the upper board edge (5) of the lower facade boards (12) by a distance equal to the thickness of the drop rabbet plus the depth of the front ventilation gap (14).

12 Claims, 5 Drawing Sheets

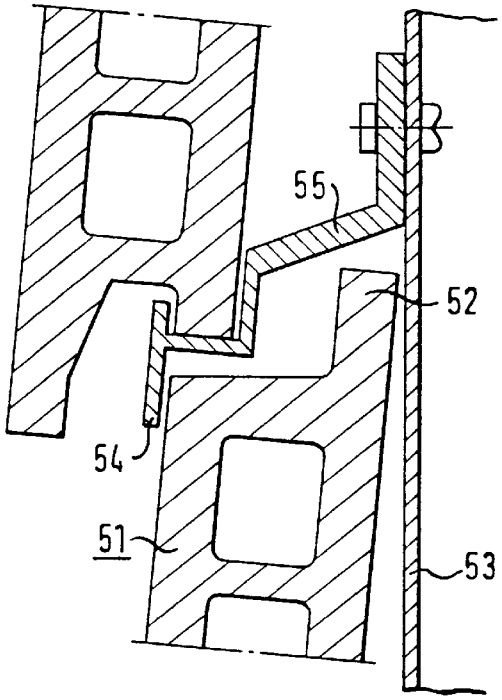
Fig. 5a
Fig. 5b
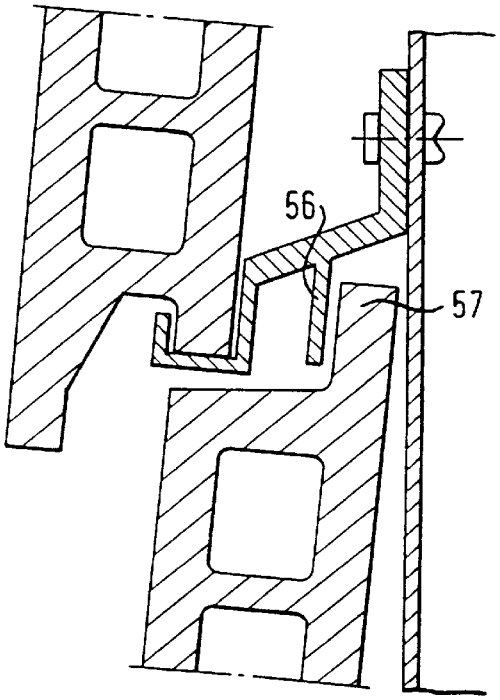
Fig. 5c
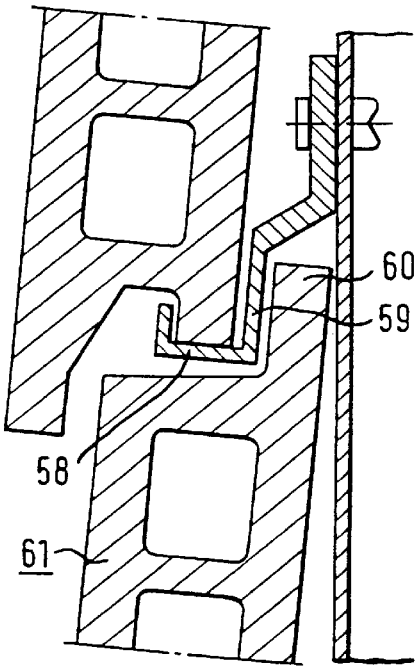

EXTERNALLY SUSPENDED FACADE SYSTEM

The invention relates to an externally suspended facade system, preferably mounted on an aluminum subsystem.

DE PS 34 01 271 has disclosed a facade whose facade boards comprise a front and a rear board section which are connected to each other by webs. Additionally, the boards are provided on the rearside with a head rabbet and a foot rabbet which, in the wall-mounted state, are arranged one below the other and around which one or more board holders engage in order to secure the H-shaped piece. Furthermore, the facade boards are provided at the front lower edge with a drop rabbet which, in the mounted state, engages over the head rabbet of the board arranged below it in such a manner that the front surfaces of the upper and lower facade boards lie in one plane. In this arrangement, the head rabbet of the lower facade boards and the board holders are overlapped by the drop rabbet of the upper facade board in such a manner that these are only partially visible.

The disadvantages of this system lie in the fact that the water guidance from the back to the front of the facade is defective. Since the back of the foot rabbets of the upper boards and the back of the head rabbets of the lower boards lie in one plane, the condensate running down the back of the upper facade boards or facade water blown by the wind through the open horizontal joints is not automatically and totally led away to the front of the facade but, to a large extent, runs on down the back of the facade boards arranged respectively below. In regions of high precipitation and wind this may result in an excessive water load on the back of the facade, so that the risk of capillary transfer of water to the supporting sections and from there to the heat insulation can arise and the latter may become soaked.

A further disadvantage lies in the fact that these known facade boards can only be mounted in such a way that the fronts of the respectively upper and lower facade boards lie in one plane. A shingle-type overlap of the upper facade boards over the lower is impossible for reasons of architectural aesthetics, since the boards are too thick for this.

A further disadvantage of this facade system is that the board holders are only partially masked by the drop rabbet and are therefore visible, which is conspicuous and undesirable especially in the case of light-colored boards.

Facade systems are also generally used in building practice in which thin facade boards are overlapped shingle-style in a double or triple covering, an angled wire holder engaging around the lower edge of the respectively upper boards. The disadvantages of this system lie in the fact that, in the case of a triple covering, virtually no ventilation gap is provided between the facade boards and, because of the flat laying of the individual sets one upon the other there is also no reliable guarantee that water will be guided from the back to the front of the facade. As a result of the direct contact between facade board and supporting batten it is even possible, in the case of the triple covering, for the water or condensate running down the back to be guided onto the supporting batten and, via this, into the heat insulation. The consequences of the defective ventilation and water guidance are the soaking of the subsystem and the heat insulation and resulting damage to the fabric.

Further disadvantages of these shingle facades in double or triple covering lie in the fact that the facade boards are relatively thin and therefore impact-sensitive and that the upper board edge is additionally subjected to breaking stress by the clamping action of the board holders.

Another important disadvantage also lies in the fact that the board holders engaging around the lower board edge cannot be designed to be either wholly or partially masked and thus have a substantially adverse effect on the appearance of the facade.

In these facades, it is also very difficult to replace individual damaged boards. The new facade board to be mounted in such cases not only has to be pushed from below into the narrow gap. In addition the board holder into which the facade board has to be lifted by its lower edge needs a much reduced inclination of the board on insertion, so that the lower edge of the facade boards arranged above has to be lifted free of the facade under prestress in order to widen the essentially parallel gap conically to such an extent that the new board can be pushed in. Since shingled facades are mounted by means of prestressed holders to avoid clattering noises in the event of wind, the replacement of individual boards is often very difficult and frequently also associated with the breakage of the new facade boards as a result of the additional stress on insertion.

The object of the invention, therefore, is to describe a facade system in which thick facade boards are masked by means of a shingle-type overlap but, at the same time, the above-mentioned disadvantages of defective water guidance and ventilation are avoided, the board holders are arranged invisibly and the possibility of replacing individual damaged facade boards is facilitated.

This object is achieved, according to the invention which includes a subsystem coupled to a vertical wall, a horizontal coupling member coupled to the subsystem, an upper facade board and a lower facade board each of the facade boards having a drop rabbet and a foot rabbet formed at a lower edge of the facade board, and a board holder coupled to the horizontal coupling members and coupled to the upper facade and lower facade boards. The drop rabbet of the upper facade board extending over the front surface of the lower facade board and extending below the upper edge of the lower facade board. A distance from the front surface of the upper facade board to the front surface of the lower facade board, in the region of the drop rabbet, is equal to a thickness of the drop rabbet plus a depth of a front ventilation gap. The advantage of this embodiment lies in the fact that relatively thick facade boards, preferably facade boards with horizontal or vertical holes, with a drop rabbet and foot rabbet at the lower edge and a head rabbet at the upper edge, can be mounted with a shingle-type overlap in such a manner that, in the finished state, the optical impression is formed that they are relatively thin facade boards which have been laid in a double or triple covering. This impression is created by the fact that, viewed from the outside of the facade, only the thickness of the drop rabbet and the depth of the ventilation slit are visible (FIG. 1). A further advantage of this embodiment lies in the fact that the condensate running down the back of the upper facade board or wind-blown facade water is completely diverted to the front of the head rabbet of the lower board and hence to the front of the facade. The result is to guarantee that not only the subsystem but also the heat insulation and the building wall remain dry and no fabric damage is caused. Furthermore, the arrangement of a ventilation gap between the back of the drop rabbet and the front of the head rabbet creates the possibility, necessary for reasons of construction physics, of passing air to and from the entire surface of the facade in order to remove moisture from the inside of the building. This also is necessary in order to avoid fabric damage. As a result of the design of the board holders, with a U-shaped piece which engages around the foot rabbet of the upper facade board from below, the depth of the ventilation gap and the vertical position of the upper facade board, and hence the dimension of the vertical covering, are defined.

As a result of the U shaped design of the board holders it is possible to vary the dimension of the vertical covering of the drop rabbet of the upper facade board over the upper edge region of the lower facade board and the depth of the horizontal ventilation gap. To achieve this, it is merely necessary to arrange the U-shaped piece of the board holder, which is open at the top, to be more or less offset downward relative to the U-shaped piece which is open at the bottom. The advantage which derives from this configuration is an enlargement or diminution of the gap height of the horizontal part of the ventilation gap. It is also possible to vary the depth of the vertical ventilation gap between the back of the drop rabbet and the front of the head rabbet by varying the horizontal offset of the two U-shaped pieces of the board holder. This has the advantage of making it possible to vary the depth both of the front part of the air gap between the foot rabbet and the front of the board and the rear part of the air gap between the back of the upper facade board and the front of the head rabbet of the lower facade board and adapt them to the needs of construction physics. Since the board holders have only a narrow width, viewed from the facade front, the ventilation cross section arranged between the board holders is primarily dependent on the depth of the front and rear ventilation gaps and on the height of the horizontal part of the middle ventilation gap. Since the two U-shaped pieces of the board holder engage both around the foot rabbet of the upper facade board and around the head rabbet of the lower facade board, with play, no stresses at all are exerted on the rabbets. This has the advantage that the danger of breakage for the rabbets in the event of additional impact stress from the front is slight. Another important advantage of the facade system according to the invention is the ease of replacing individual damaged facade boards. The facade board to be replaced simply needs to be pushed from below, by the head rabbet, into the U-shaped piece of the board holder engaging over this from above, without it being necessary to touch, still less to lift and loosen, the upper boards or the board holders. It is merely necessary, at the points at which the U-shaped pieces of the holder engage over the head rabbet of the board to be inserted, to reduce the height of the head rabbet by a few millimeters so that this facade board can be raised a few millimeters higher, so that its foot rabbet can be lifted over the lower front flange of the U-shaped piece of the board holder, which is open at the top. The replaced facade board is secured against unauthorized removal by the fact that the U-shaped piece of the board holder, engaging around the head rabbet from above, is filled with an initially plastic and subsequently curing compound. A further advantage of the facade system according to the invention as compared with the state of the art is the fact that the board holders are arranged completely invisibly and cannot be seen either from the horizontal angle of view or in an oblique upward view.

In another embodiment of the facade system according to the invention (FIG. 2) the horizontal offset of the U-shaped piece of the board holder engaging around the foot rabbet of the upper facade board in front of the U-shaped piece engaging around the head rabbet of the lower facade board is much greater than is shown in FIG. 1. This is possible as a result of the fact that a spacer web is arranged between the two U-shaped pieces. The advantage of this system lies in the fact that the facade boards can be equipped with a much thicker and hence more breakage-resistant drop rabbet than is shown in FIG. 1, yet at the same time the same depth of the ventilation gap arranged between the drop rabbet of the upper board and the front of the lower board can be retained. A further advantage lies in the fact that the depth of this ventilation gap can also be additionally increased. As a result of the particularly wide vertical ventilation gap in front of the head rabbet of the lower facade board, particularly reliable water guidance from the back of the upper board to the front of the lower one is also guaranteed.

In other alternative embodiments (FIGS. 3*a* and 3*b*) the facade boards are embodied without a head rabbet. Although this is associated with the disadvantage of inferior water guidance from the back to the front, it does have the advantage that the production of, in particular, ceramic facade boards without a head rabbit is somewhat easier. In particular, however, the facade board can be cut as desired at the upper edge for the purposes of vertical dimensional fitting during assembly without its overall thickness changing, so that the U-shaped piece of the board holder engaging over the lower facade boards from above always has precisely the correct overall depth adjusted to the board thickness. This alternative embodiment without head rabbet is particularly suitable for climatic regions with low precipitation and little wind. In the case of facade boards cut to size at the upper edge, the condensate or water running down the back can be diverted into the vertical joint at the lateral end of the board.

In another advantageous form of embodiment (FIG. 4*a*) of the facade system according to the invention, instead of a U-shaped piece, open at the bottom, of the board holder engaging around the head rabbet or the upper edge of the lower facade board, there is merely a single flange that engages behind it. The facade board is supported at the back by this flange, so that the gap necessary for the ventilation between the back of the head rabbet and/or of the facade boards and the front edge of the horizontal section is kept open. The horizontal movement of the upper edge of the boards toward the front of the facade can be prevented by suitable spacers between the facade boards. The advantage of this alternative embodiment lies in the fact that the board holders have a shape that is even slightly simpler.

In a further alternative embodiment (FIGS. 5*a*, 5*b* or 5*c*) the head rabbet or the rear upper edge of the lower facade board is supported directly and without spacing on a horizontal or vertical section of the subsystem. In this arrangement the head rabbet or the upper board edge of the lower board is secured against tilting toward the front of the facade by a flange of the board holder, which engages from above in front of the upper edge of the lower facade board or its head rabbet. The advantage of this system, without an air gap between the head rabbet or head of the facade board and the subsystem, lies in the particularly simple embodiment of the board holders and in the reduced structural depth of the entire facade system.

In another form of the facade system according to the invention, an upward-directed flange of the board holder engages into the groove between the drop rabbet and foot rabbet of the facade board (FIG. 6), which is of correspondingly narrow design in order to fix the foot of the board horizontally. In this type of embodiment, the rear flange of the U-shaped piece, open at the top, of the board holder can be omitted. The advantage of this form of embodiment lies in the fact that the narrow groove between the drop rabbet and the foot rabbet can also be sawn or cut in a particularly simple manner.

Various embodiments of the invention are explained by way of example in the description which follows, with reference to drawings, as follows.

Figure 1:
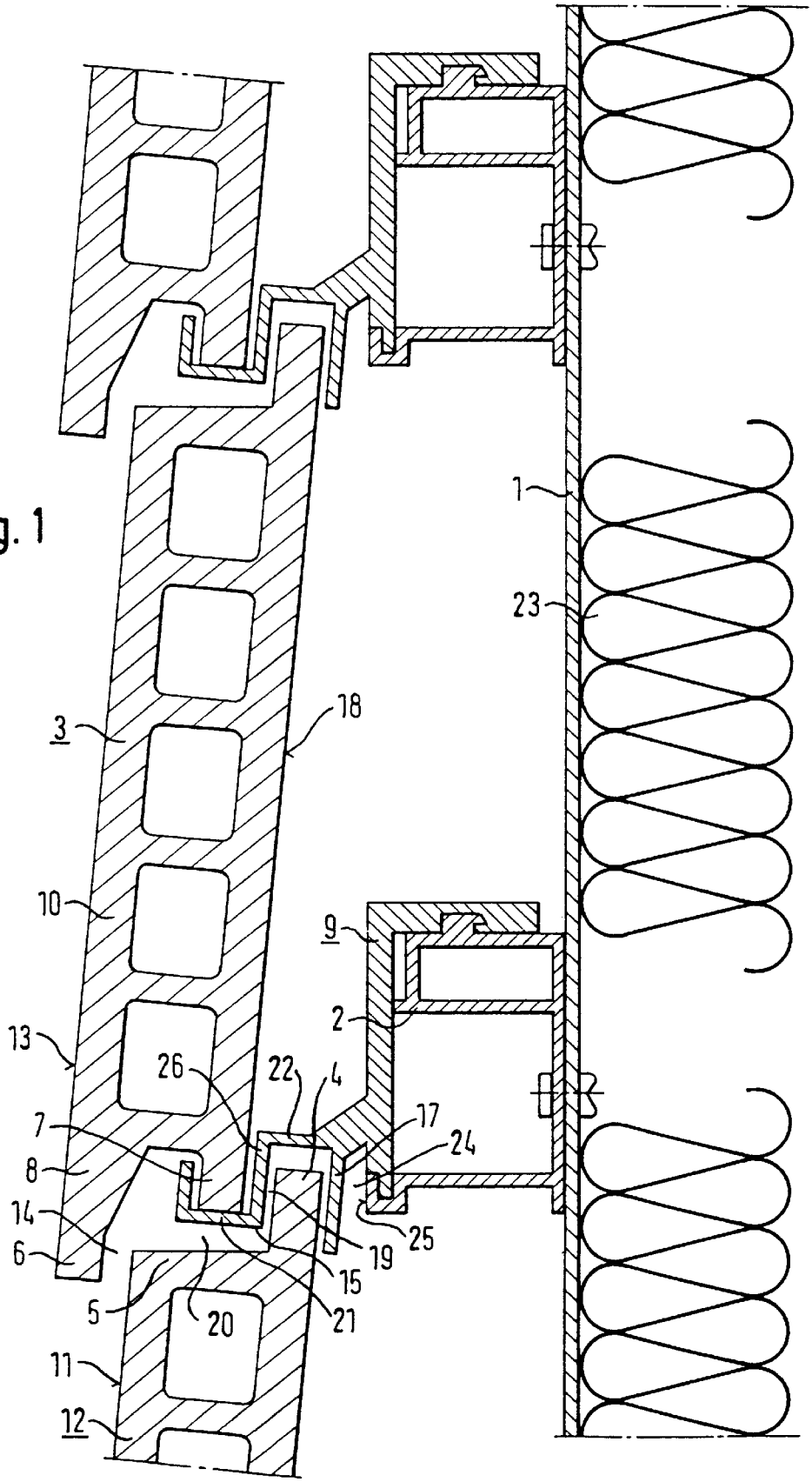
FIG. 1 shows a vertical section through the facade system according to a first embodiment of the invention.
Figure 3A:
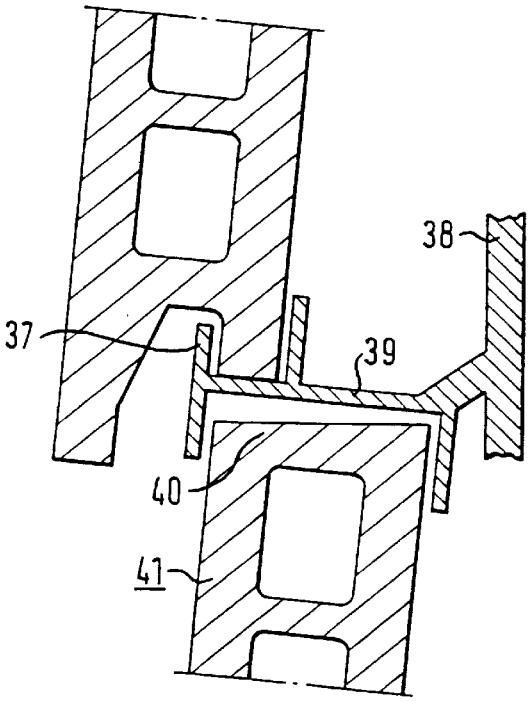
Figure 3B:
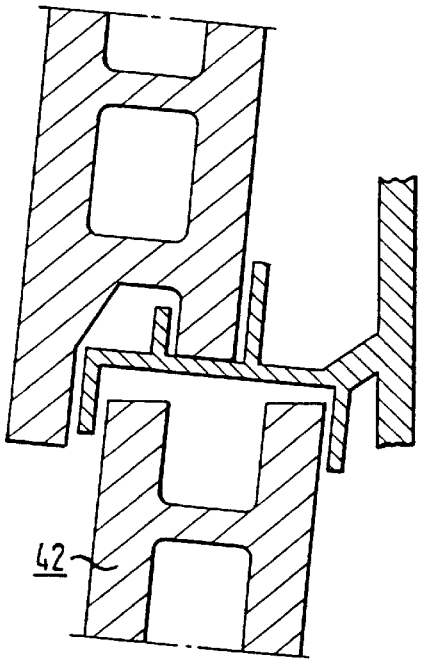
Figure 4A:
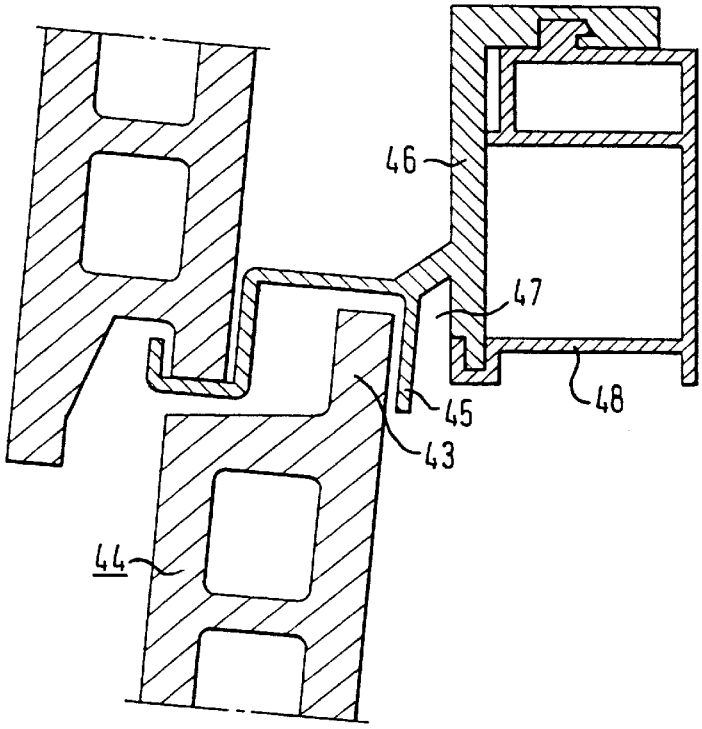
Figure 4B:
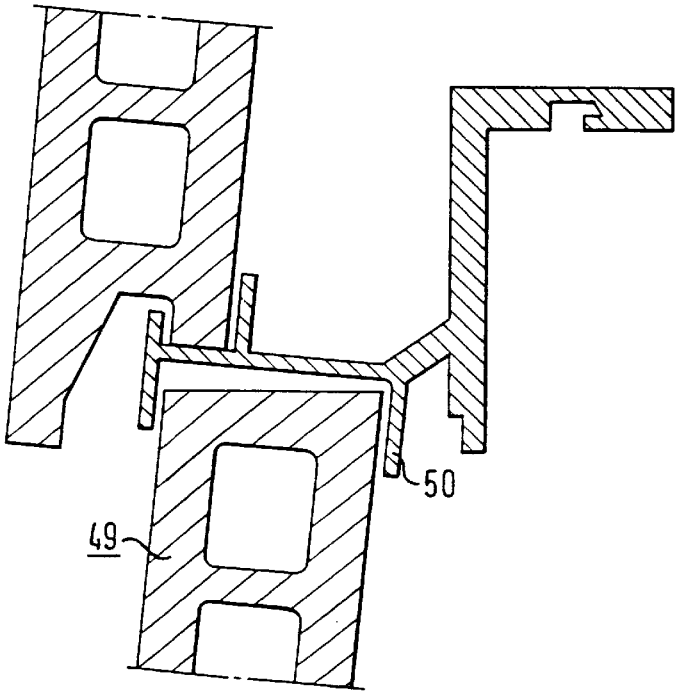
Figure 6:
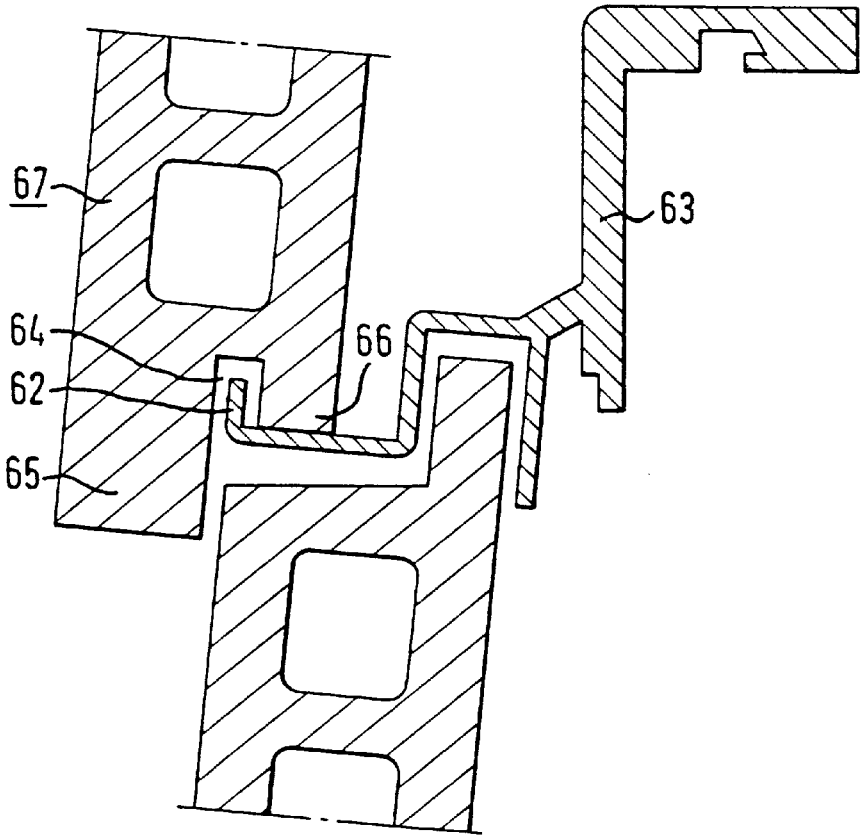

FIG. 3*a* shows a vertical section according to a third embodiment of the present invention FIG. 3*b* therefor according to the third embodiment FIG. 4*a* therefor according to a fourth embodiment FIG. 4*b* therefor according to a fifth embodiment FIG. 5*a* therefor according to a sixth embodiment FIG. 5*b* therefor according to a seventh embodiment FIG. 5*c* therefor according to a eighth embodiment FIG. 6 therefor according to a ninth embodiment FIG. 1 shows a vertical subsystem 1 with a horizontal section 2 and a facade board 3 having a head rabbet 4 at the upper board edge 5 and having a drop rabbet 6 and a foot rabbet 7 at the lower board edge 8, which is secured by means of a board holder 9 on the horizontal section 2. In this arrangement the drop rabbet 6 of the upper facade board 10 engages over the front surface 11 of the upper board edge 5 of the lower facade board 12 in such a way that the front surface 13 of the upper facade board 10 in the region of the drop rabbet 6 is arranged in front of the front surface 11 of the upper board edge 5 of the lower facade board 12 by an amount equal to the thickness of the drop rabbet plus the depth of the front ventilation gap 14. The U-shaped piece 15, open at the top, of the board holder 9 engages around the foot rabbet 7 of the upper facade board 3 from below, and the U-shaped piece 17, open at the bottom, engages around the head rabbet 4 of the lower facade board 12 from above. The connecting web 21 of the U-shaped piece 15, open at the top, is arranged offset relative to the connecting web 22 of the U-shaped piece 17, open at the bottom, of the board holder 9, in both the height and the depth of the facade. The front leg 26 of the U-shaped piece 17 in FIG. 1 is identical to the rear leg 26 of the U-shaped piece 15. Condensate or penetrating facade water which runs down the back 18 of the upper facade board 3 is diverted into the vertical rear ventilation gap 19 in front of the head rabbet 4 of the lower facade board 12 and thus necessarily flows through the horizontal ventilation gap 20 and the front vertical ventilation gap 14 to the front surface 11 of the lower facade board 12. This guarantees that not only the horizontal section 2 and the subsystem 1 but also the heat insulation 23 remain dry. The passing of air to and from the air space arranged behind the facade boards takes place through the open ventilation gaps 14, 20 and 19 between the board holders 9 (arranged one behind the other in the plane of the drawing). A further ventilation gap 24 between the back of the facade board 12 and the front edge 25 of the horizontal section 2 also serves for the capillary separation of the back of the facade board 12 from the horizontal section 2.

Figure 2:
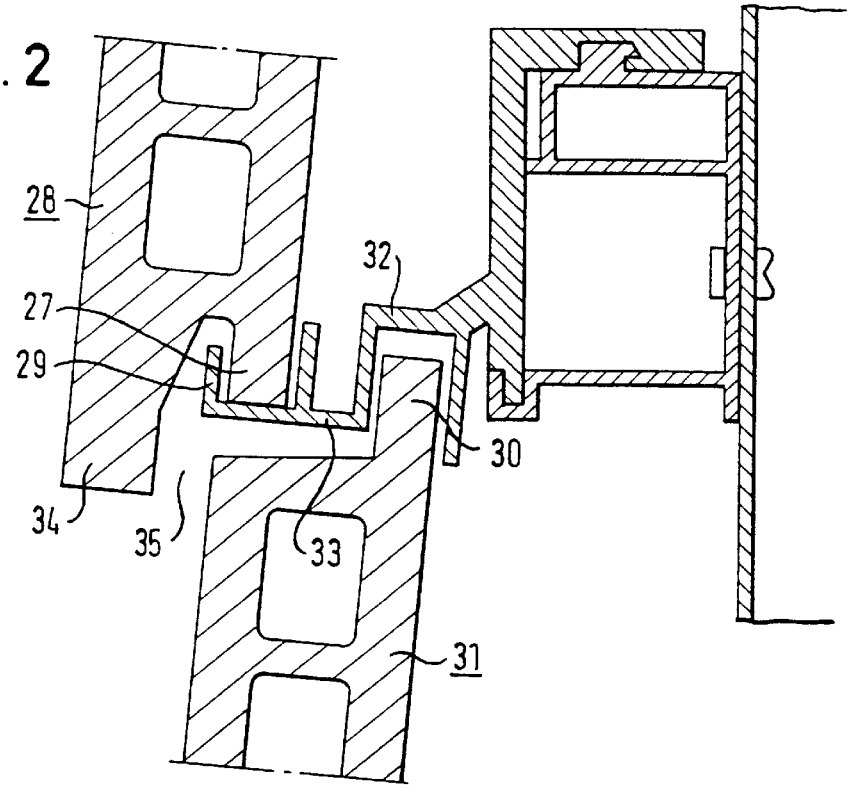
FIG. 2 shows a vertical section through the region in which the facade boards overlap according to a second embodiment of the present invention.

FIG. 2 shows another embodiment in which the U-shaped piece 29 engaging around the foot rabbet 27 of the upper facade board 28 is further offset toward the front of the facade. A spacer web 33 is arranged between the U-shaped piece 29 and the U-shaped piece 32 engaging around the head rabbet 30 of the lower facade board 31. As a result it is possible to provide a particularly thick and hence breakage-proof drop rabbet 34 on the upper facade board 28. The ventilation gap 35 is also deeper in FIG. 2 than in FIG. 1 as a result.

FIG. 3*a* shows an embodiment with facade boards 41 without head rabbet. In this arrangement, the U-shaped piece 37, open at the top, of the board holder 38 is arranged offset in the direction of the depth of the facade system relative to the U-shaped piece 39, open at the bottom, which engages around the upper edge 40.

FIG. 3*b* shows an alternative embodiment in which the two U-shaped pieces are only slightly offset in the direction of the depth of the facade system. Furthermore, FIG. 3*b* shows a lower facade board 42 which is cut to size at the upper edge for purposes of vertical adjustment.

FIG. 4*a* shows an embodiment in which the head rabbet 43 of the lower board 44 is supported at the back by a flange 45 of the board holder 46, so that the ventilation gap 47 between the facade board 44 and the horizontal section 48 is secured.

FIG. 4*b* shows an alternative embodiment in which a facade board 49 without head rabbet is supported at the back by the flange 50.

FIG. 5*a* shows a facade board 51 which is supported by its head rabbet 52 on the section 53 of the subsystem and is secured against tilting forward by the flange 54 of the board holder 55.

FIG. 5*b* shows a flange 56 in front of the head rabbet 57.

FIG. 5*c* shows the U-shaped piece 58, open at the top, whose vertical flange 59 secures the head rabbet 60 of the facade board 61.

FIG. 6 shows the facade system in which a vertical, upward-directed flange 62 at the front end of the board holder 63 engages into the narrow groove 64 between the drop rabbet 65 and the foot rabbet 66 of the upper facade board 67.

The invention further relates to a facade board holder for holding a facade board, in particular a facade board with or without a head rabbet at the upper board edge and having a drop rabbet and foot rabbet at the lower board edge, in particular a facade board which comprises a front and a rear board section which are connected to each other by webs. In order to achieve the object stated above, such a facade board holder is characterized by a U-shaped piece, open at the top, for engaging around the foot rabbet of the upper facade board. Advantageous further developments are indicated in subclaims 9 to 13.

The invention further relates to a facade board comprising a front and a rear board section which are connected to each other by webs. In order to achieve the object stated above, this facade board is characterized according to the invention by having a drop rabbet and a foot rabbet at a lower end thereof. An advantageous further development is one in which the facade board does not have a head rabbet.

What is claimed is:

1. An externally suspended, back-ventilated facade system attached to a vertical wall, the facade system comprising:

a subsystem coupled to the vertical wall, the subsystem having an external surface;

a horizontal coupling member coupled to the subsystem;

an upper facade board and a lower facade board, the upper facade board being disposed vertically above the lower facade board, each of the facade boards having an upper edge, a lower edge, a front surface and a back surface, the back surface facing the external surface of the subsystem, each of the facade boards further having a drop rabbet and a foot rabbet formed at the lower edge of the facade board, the drop and foot rabbets forming projections from the lower edge of the facade board, the foot rabbet extending coplanar with the back surface of the facade board and the drop rabbet extending coplanar with the front surface of the facade board; and a board holder coupled to the horizontal coupling member and coupled to the upper facade and lower facade boards such that:

the drop rabbet of the upper facade board extends over the front surface of the lower facade board and extends below the upper edge of the lower facade board, wherein a distance from the front surface of the upper facade board to the front surface of the lower facade board, in the region of the drop rabbet, is equal to a thickness of the drop rabbet plus a depth of a front ventilation gap; and the back surface of the upper facade board at the lower edge thereof is further away from the vertical wall than the back surface of the lower facade board at the upper edge thereof.

2. The facade system as claimed in claim 1, wherein the board holder includes a U-shaped piece, open at the top, which engages from below around the foot rabbet of the upper facade board.

3. The facade system as claimed in claim 1, wherein the board holder includes a U-shaped piece, open at the bottom, which engages from above around the upper edge of the lower facade board.

4. The facade system as claimed in claim 3, wherein the U-shaped piece open at the bottom is a first U-shaped piece, the board holder further including a second U-shaped piece, open at the top, which engages from below around the foot rabbet of the upper facade board, wherein a connecting web of the first U-shaped piece is arranged offset in a direction of a horizontal depth of the facade system relative to a connecting web of the second U-shaped piece.

5. The facade system as claimed in claim 1, wherein the lower facade board includes a head rabbet formed at the upper edge of the boards, the head rabbet of the lower facade board being supported at its back surface by a downward-engaging flange of the board holder.

6. The facade system as claimed in claim 1, wherein the board holder includes a downward-engaging flange which engages over the front surface of the lower facade board at its upper edge.

7. The facade system as claimed in claim 1, wherein the board holder includes a vertical upward-directed flange which engages into a groove between the drop rabbet and the foot rabbet of the upper facade board.

8. A facade board holder holding facade boards against a vertical wall, each of the facade boards having an upper edge, a lower edge, a front surface, a back surface, drop and foot rabbets forming projections from the lower edge of the facade board, the foot rabbet extending coplanar with the back surface of the facade board and the drop rabbet extending coplanar with the front surface of the facade board, the facade board holder comprising:

a first U-shaped piece, open at the top, engaging around the foot rabbet of a facade board; and a second U-shaped piece, open at the bottom, engaging around the upper edge of a facade board, such that the back surface of the upper facade board at the lower edge thereof is further away from the vertical wall than the back surface of the lower facade board at the upper edge thereof.

9. The facade board holder as claimed in claim 8, wherein a connecting web of the second U-shaped piece is arranged offset relative to a connecting web of the first U-shaped piece.

10. The facade board holder as claimed in claim 8, further comprising a downward-engaging flange supporting the back surface of a lower facade board.

11. The facade board holder as claimed in claim 8, further comprising a downward-engaging flange engaging over the front surface of a facade board at the upper edge.

12. The facade board holder as claimed claim 8, further comprising a vertical upward-directed flange engaging into a groove between the drop rabbet and foot rabbet of a facade board.

* * * * *